US006206771B1

(12) United States Patent
Lehman

(10) Patent No.: US 6,206,771 B1
(45) Date of Patent: Mar. 27, 2001

(54) BALANCER FOR ORBITAL ABRADING MACHINE

(75) Inventor: Frank D. Lehman, Wilson, NY (US)

(73) Assignee: Dynabrade, Inc., Clarence, NY (US)

( * ) Notice: Subject to any disclaimer, the term of this patent is extended or adjusted under 35 U.S.C. 154(b) by 0 days.

(21) Appl. No.: 09/236,947

(22) Filed: Jan. 25, 1999

(51) Int. Cl.[7] ..... B24B 23/04
(52) U.S. Cl. ..... 451/357; 451/359; 451/345
(58) Field of Search ..... 451/345, 359, 451/357, 353

(56) References Cited

U.S. PATENT DOCUMENTS

| | | | | |
|---|---|---|---|---|
| Re. 29,247 | * | 6/1977 | Kilstrom et al. | 15/380 |
| 3,866,489 | * | 2/1975 | Kimmelaar | 74/573 |
| 4,660,329 | * | 4/1987 | Hutchins | 51/170 |
| 4,729,194 | * | 3/1988 | Maier et al. | 51/170 |
| 4,811,522 | * | 3/1989 | Gill, Jr. | 51/131.1 |
| 4,854,085 | | 8/1989 | Huber | 51/170 |
| 5,040,340 | * | 8/1991 | Bischof et al. | 51/170 |
| 6,007,412 | * | 12/1999 | Hutchins | 451/295 |

OTHER PUBLICATIONS

Hamilton H. Mabie & Fred W. Ocvirk, "Mechanisms and Dynamics of Machinery", Third Edition, Chapter 12, pp. 490–497.

SKF, "Auto–Balancing", 4597E, 1997, pp. 1–5, 7–8.

Jonas Nlisagard & Helene Richmond, "Auto–Balancing Cuts Vibration By Half", Jan. 1995, pp. 27–30.

* cited by examiner

*Primary Examiner*—Allen M. Ostrager
*Assistant Examiner*—William Hong
(74) *Attorney, Agent, or Firm*—Simpson, Simpson & Snyder, L.L.P.

(57) ABSTRACT

A random orbital abrading machine having a housing, a drive shaft driven by a housing mounted motor for rotation about a first axis of rotation, an assembly for connecting a work surface abrading pad or the like to the drive shaft, wherein the pad is adapted to undergo free rotational movement about a second axis disposed parallel to the first axis of rotation, as such pad is caused to orbit about such first axis of rotation, characterized in that the assembly is designed for dampening vibration due to a drag force acting on the pad when engaged with the work surface under predetermined working conditions.

1 Claim, 4 Drawing Sheets

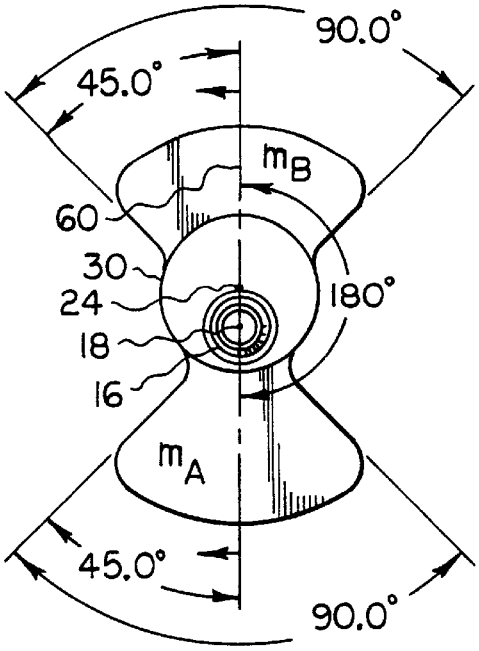
FIG. 4a
PRIOR ART
FIG. 4b
PRIOR ART
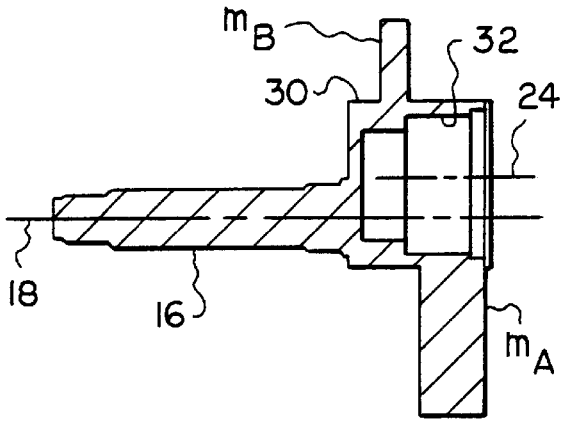
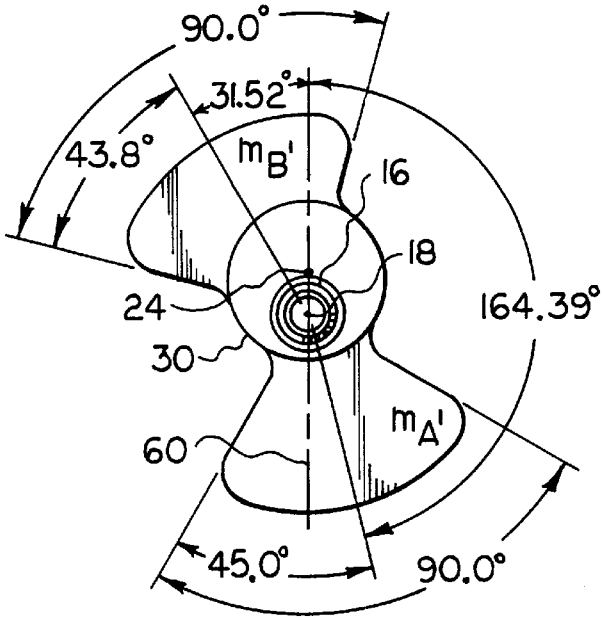
FIG. 5a
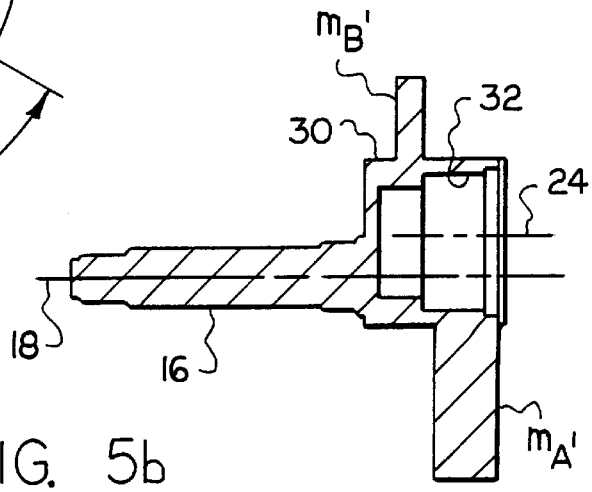
FIG. 5b

BALANCER FOR ORBITAL ABRADING MACHINE

BACKGROUND OF THE INVENTION

Orbital abrading machines are well-known and generally comprise a portable, manually manipulatable housing, a motor supported by the housing and having or being coupled to a drive shaft driven for rotation about a first axis, and an assembly for mounting a pad for abrading a work surface for orbital movement about the first axis. In a random orbital abrading machine, the assembly serves to additionally mount the pad for free rotational movement about a second axis, which is disposed parallel to the first axis.

The assembly typically includes a head portion coupled for driven rotation with the drive shaft about the first axis and defining a mounting recess having an axis arranged coincident with the second axis, a bearing supported within the mounting recess, and means for connecting the pad to the bearing for rotation about the second axis.

Orbital machines by nature are subject to dynamic unbalance and require the inclusion of a counterbalance system to reduce vibration to an acceptance level. The typical design approach has been to account only for the unbalance, which is created by the mass centers of the pad and portions of the assembly not disposed concentric to the first axis, by the addition of balancing masses to the housing. This approach can create a machine that is balanced, that is, has acceptably low vibration levels, while the machine is running at free speed in an unloaded condition. However, once the machine is loaded, as a result of placing the pad in abrading engagement with a work surface, additional forces are introduced and the machine becomes unbalanced and this unbalance is detected by the operator in the form of vibration. This is undesirable and in severe cases, may lead to vibration induced injuries such as carpal tunnel syndrome and white finger.

The counterbalance system referred to above, which may be used in the design of both orbital and random orbital machines, is described for example in Chapter 12 of Mechanisms and Dynamics of Machinery, Third Edition, by Hamilton H. Mabie and Fred W. Ocvirk, published by John Wiley & Sons.

Another approach is that adopted for the Atlas Copco Turbo Grinder GTG40, which uses an SKF Nova AB auto-balancing unit to reduce vibration under various loading conditions. This unit features the use of a plurality of ball bearings, which are arranged within an annular raceway and free to move therewithin as required to reducing vibrations.

SUMMARY OF THE INVENTION

It is known that both orbital and random orbital abrading machines, which include for example, sanding, grinding and buffing machines, that have been balanced to minimize vibration under no load operating conditions, may be subjected to unacceptable levels of vibration under actual working conditions.

The present invention relates to an improved, orbital abrading machine, and more particularly to an improved random orbital buffer, which may be counterbalanced in such a manner as to minimize vibrations under actual working conditions.

The present invention is based on the realization that known balancing techniques, which may be employed to achieve proper balancing under unloaded conditions, do not take into consideration forces at work, during actual working conditions, which oftentimes result in a properly balanced machine becoming unbalanced to an unacceptable degree during use. More particularly, the present invention is directed towards a counterbalancing system adapt to minimize vibration of a orbital abrading machine under determined operating conditions.

BRIEF DESCRIPTION OF THE DRAWINGS

The nature and mode of operation of the present invention will now be more fully described in the following detailed description taken with the accompanying drawings wherein:

FIG. 4*a* is an end view of a head portion of an assembly employed to couple an abrasive pad to a drive motor of an orbital abrading machine, which is provided with a pair of masses arranged in accordance with a known counterbalancing system;

FIG. 4*b* is a sectional view taken along the line A—A in FIG. 4*a;*

FIG. 5*a* is an end view of a head portion of an assembly employed to couple an abrasive pad to a drive motor of an orbital abrading machine, which is provided with a pair or masses arranged in accordance with the present invention to minimize vibration of the machine under intended working conditions; and FIG. 5*b* is a sectional view taken along the line A—A in FIG. 5*a.*

DETAILED DESCRIPTION

Figure 1:
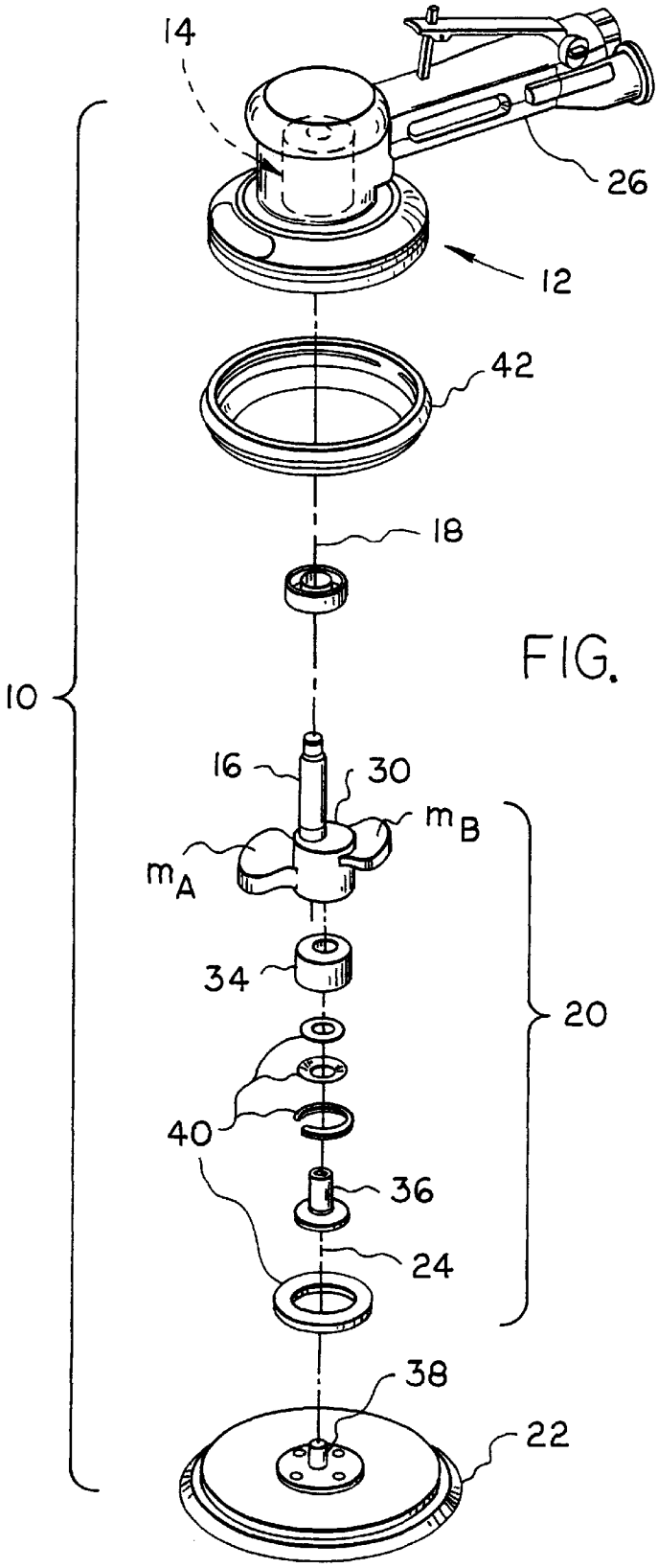
FIG. 1 is an exploded prospective view of a random orbital abrading machine embodying the present invention.

Reference is first made to FIG. 1, wherein an orbital abrading machine is generally designated as 10 and shown as generally including a manually manipulated housing 12, a motor 14 mounted within the housing and including or being suitably coupled to a drive shaft 16 driven for rotation about a first axis 18, and an assembly 20 which serves to connect an abrasive pad 22 to drive shaft 16 such that the pad is caused to orbit about the first axis.

Preferably machine 10 is in the form of a random orbital machine in which abrasive pad 22 is supported by assembly 20 for free rotational movement about a second axis 24, which is disposed parallel to and orbits about first axis 18. Housing 12 may be fitted with a manually manipulatable handle 26 and motor may be a pneumatically driven motor connected to a suitable supply of air under pressure.

Assembly 20 may be similar to that described in commonly assigned U.S. Pat. No. 4,854,085 in that it generally includes a head portion 30 mechanically coupled to or formed integrally with drive shaft 16 and formed with a generally cylindrical mounting recess, which is designated as 32 only in FIGS. 4*b* and 5*b*. This mounting recess has an axis disposed coincident with second axis 24 and is sized to mount a bearing 34 therewithin. Bearing 34 serves in turn to support means for connecting pad 22 to bearing 34, such as may be defined by a mounting shaft 36, which is disposed for rotation concentrically of axis 24 and formed with an axially extending threaded mounting opening, not shown, for removably receiving an abrasive pad mounting fastener 38. Also shown in FIG. 1 are known seal and seal mounting devices 40 for use in preventing the ingress of undesired materials upwardly into bearing 34 and an annular shroud 42 adapted to be mounted on housing 12 to extend peripherally of pad 22.

A machine having an element, such as pad 22, driven for movement about an orbital path of travel is by nature unbalanced and tends to produce vibrations, which may be felt by the hands of an operator of the machine. With a view towards maintaining such vibrations at acceptable levels, it has been common practice to employ a counterbalance system of the type described in Chapter 12 Mechanisms and Dynamics of Machinery, Third Edition, by Hamilton H. Mabie and Fred W. Ocvirk, published by John Wiley and Sons, which is incorporated by reference herein. To facilitate understanding of this prior system and its use in counterbalancing of a sample orbital machine, reference is made to the balance sketch illustrated in FIG. 2 and TABULATION I set forth below:

masses $m_1$ and $m_2$ are disposed from a selected parallel reference plane disposed normal to axis 18, such as may be conveniently defined by a working surface of pad 22 to be presented for abrading engagement with a work surface, not shown. For the case of the sample orbital machine, the center of the pad working surface is located at point 50 shown in FIG. 2, and the centers of masses $m_1$ and $m_2$ are assumed to lie in approximate alignment with second axis 24, such that the angle θ for each mass can be assumed to be essentially 0°.

The sample orbital machine may be balanced by adding two or more balancing masses, as for instance $m_A$ and $m_B$, whose centers lie at suitable radial distances $r_A$ and $r_B$ from first axis 18 and within selected planes disposed parallel and spaced through distances $z_A$ and $z_B$ from the above reference plane. The number of balancing masses and their relative positions may be varied depending on installation requirements and choice of the designer of the machine. The requirement for obtaining a balanced machine is that masses $m_A$ and $m_B$ be sized and arranged such that the sum of the TABULATION I
General Random Orbital Input

| mass 1 | | mass 2 | | Balancing plane | Z |
|---|---|---|---|---|---|
| m1 (g) | 202 | m2 (g) | 75.6 | A (mm) | 32 |
| r1 (mm) | 7 | r2 (mm) | 7 | B (mm) | 44.8 |
| θ1 (°) | 0 | θ2 (°) | 0 | C = B − A (mm) | 12.8 |
| Z1 (mm) | 19.4 | Z2 (mm) | 43 | | |

Balancing Table

| | m | r | mr | Z | | Balancing Plane A | | | | Balancing Plane B | | | |
|---|---|---|---|---|---|---|---|---|---|---|---|---|---|
| Plane | (g) | (mm) | (g*mm) | (mm) | θ | b | mrb | (mrb)cosθ | (mrb)sinθ | a | mra | (mra)cosθ | (mra)sinθ |
| From Input | | | | | | | | | | | | | |
| 1 | 202 | 7 | 1414 | 19.4 | 0 | 25.40 | 35915.60 | 35915.60 | 0.00 | −12.60 | −17816.40 | −17816.40 | 0.00 |
| 2 | 75.6 | 7 | 529.2 | 43 | 0 | 1.80 | 952.56 | 952.56 | 0.00 | 11.00 | 5821.20 | 5821.20 | 0.00 |
| Summation (Σ) | | | | | | | | 36868.16 | 0.00 | | | −11995.20 | 0.00 |
| Calculated Values | | | | | | | | | | | | | |
| Balancer A | | | 2880.3★ | 32 | 180.0* | 12.80 | 36888.16 | −36868.16 | 0.00 | 0.00 | 0.00 | 0.00 | 0.00 |
| Balancer B | | | 937.1★★ | 44.8 | 0.0** | 0.00 | 0.00 | 0.00 | 0.00 | 12.80 | 11995.20 | 11995.20 | 0.00 |
| SUM | | | | | | | | 0.00 | 0.00 | | | 0.00 | 0.00 |

Solution Summary

| Plane | mr (g*mm) | θ (°) |
|---|---|---|
| Balancer A | 2880.3 | 180.00 |
| Balancer B | 937.1 | 0.00 |

where
★(mr)A = (((Σmrbcos θ)^2 + (Σmrbsin θ)^2)^.5)/C
★★(mr)B = (((Σmracos θ)^2 + (Σmrasin θ)^2)^.5)/C
*tan(θ)A = −(Σmrasin θ)/−(Σmracos θ)
**tan(θ)B = −(Σmrbsin θ)/−(Σmrbcos θ)

It will be understood that $m_1$ is a first mass defined by pad 22, bearing 34, mounting shaft 36, mounting fastener 38, and sear and seal mounting devices 40; $m_2$ is a second mass defined by portions of housing 30 not disposed concentrically of axis 18; $r_1$ and $r_2$ are the radial distances of the centers of masses $m_1$ and $m_2$ from the first rotational axis 18; and $z_1$ and $z_2$ are the distances of transverse planes in which values of the columns (mrb) cos θ, (mrb) sin θ, (mra) cos θ and (mra) sin θ for $m_1$, $m_2$ and $m_A$ and $m_B$ appearing in the Balancing Table of TABULATION I be equal to zero. As the values of these columns progressively increase from zero, vibration caused by unbalance progressively increases.

In the solution shown in the Solution Summary of TABULATION I and illustrated in FIG. 4*a,* the centers of masses $m_A$ and $m_B$ are arranged at 180° and 0° degrees relative to axis 18, and these masses are symmetrical relative to a plane 60 in which parallel axes 18 and 24 are disposed.

An orbital or random orbital machine once balanced in accordance with the above-referenced prior practice, will remain in balance regardless of the rotation speed of the drive shaft, so long as pad 22 is permitted to rotate under unloaded conditions. However, as soon as pad 22 is loaded, as by being placed in abrading engagement with a work surface, the original balance is lost and an operator is exposed to varying degrees of vibration depending on the working conditions under which the orbital machine is used.

With certain orbital machines, such as sanders, the degree of unbalance, and thus vibration experienced by an operator under typical working conditions, is normally found to be within acceptable limits. However, for other orbital machines, such as for example, buffers, the degree of unbalance is typically found to be greater and may reach a level at which prolonged use of the machine may cause serious vibration induced injury to an operator.

The present invention seeks to provide an orbital or random orbital machine, which is adapted to be balanced while exposed to predetermined working conditions under which the machine is intended for use, so as to minimize vibrations to which an operator is exposed, while actually using the machine for performing a given type of abrading operation.

In attempting to solve the problem of an unacceptably high vibration level experienced with the use of a random orbital buffer intended for use in the finishing of painted vehicle surfaces, it was realized that the above-described prior balancing technique for orbital machines did not take into account working loads, such as drag caused by bearing engagement of the abrading or buffing pad with the painted surface, and that is was necessary to consider the angular velocity of masses $m_1$, $m_2$, $m_A$ and $m_B$ in order to determine the values and positions required to be assumed by balancing masses $m_A$ and $m_B$ in order to achieve balance under actual working conditions.

To facilitate understanding of the present invention, reference is made to the balance sketch of FIG. 3 and TABULATIONS II and III set forth below:

TABULATION II
Orbital with Drag Force

Input

| mass 1 | | mass 2 | | Balancing plane | Z | Loading | |
|---|---|---|---|---|---|---|---|
| m1 (g) | 202.0 | m2 (g) | 75.6 | A (mm) | 32.0 | RPM under load | 5,000 |
| r1 (mm) | 7.0 | r2 (mm) | 7.0 | B (mm) | 44.8 | Drag force (N) | 63.0 |
| θ1 (°) | 0.0 | θ2 (°) | 0.0 | C = B − A (mm) | 12.8 | angle (°) | 90.0 |
| Z1 (mm) | 19.4 | Z2 (mm) | 43.0 | | | Placement (mm) | 0.0 |

Balancing Table

| Plane | m (g) | r (mm) | mr (g*mm) | ω^2 (rad/a/s) | Force (N) mrω^2 | Force (N) Drag | Z (mm) | θ |
|---|---|---|---|---|---|---|---|---|
| **From Input** | | | | | | | | |
| 1 | 202 | 7 | 1,414.0 | 274,156 | 387.7 | | 19.4 | 0.0 |
| 2 | 75.6 | 7 | 529.2 | 274,156 | 145.1 | | 43.0 | 0.0 |
| Drag | | | | | | 63.0 | 0.0 | 90.0 |
| Summation (Σ) | | | | | | | | |
| **Calculated Values** | | | | | | | | |
| Balancer A | | | [i]2,990.5 | 274,156 | 819.9★ | | 32.0 | −164.4* |
| Balancer B | | | [ii]1,099.2 | 274,156 | 301.4★★ | | 44.8 | 31.5** |
| SUM | | | | | | | | |

| Plane | Balancing Plane A b | force*b | (force*b)cosθ | (force*b)sinθ | Balancing Plane B a | force*a | (force*a)cosθ | (force*a)sinθ |
|---|---|---|---|---|---|---|---|---|
| **From Input** | | | | | | | | |
| 1 | 25.40 | 9,846.5 | 9,846.5 | 0.0 | −12.60 | −4,884.5 | −4,884.5 | 0.0 |
| 2 | 1.80 | 261.1 | 261.1 | 0.0 | 11.00 | 1,595.9 | 1,595.9 | 0.0 |
| Drag | 44.80 | 2,822.4 | 0.0 | 2,822.4 | −32.00 | −2,016.0 | 0.0 | −2,016.0 |
| Summation (Σ) | | | 10,107.6 | 2,822.4 | | | −3,288.6 | −2,016.0 |
| **Calculated Values** | | | | | | | | |
| Balancer A | 12.80 | 10,494.3 | −10,107.6 | −2,822.4 | 0.00 | 0.0 | 0.0 | 0.0 |
| Balancer B | 0.00 | 0.0 | 0.0 | 0.0 | 12.80 | 3,857.3 | 3,288.6 | 2,016.0 |
| SUM | | | 0.0 | 0.0 | | | 0.00 | 0.00 |

-continued

TABULATION II
Orbital with Drag Force

Solution Summary

| Plane | mr (g*mm) | θ (°) |
|---|---|---|
| Balancer A | 2,990.5 | −164.40 |
| Balancer B | 1,099.2 | 31.51 |

where:
★(force)A = (((Σforce*b*cos θ)^2 + (Σforce*B*sin θ)^2)^.5)/C
★★(force)B = (((Σforce*a*cos θ)^2 + (Σforce*a*sin θ)^2)^.5)/C
*tan( θ)A = −(Σforce*a*sin θ)/−(Σforce*a*cos θ)
**tan( θ)B = −(Σforce*b*sin θ)/−(Σforce*b*cos θ)
and:
[i](mr)A = (force)A*1e6/ω^2
[ii](mr)B = (force)B*1e6/ω^2

TABULATION III
Free Speed, No Drag Applied Yet

Input

| mass 1 | | mass 2 | | Balancing plane | Z | Loading | |
|---|---|---|---|---|---|---|---|
| m1 (g) | 202.0 | m2 (g) | 75.6 | A (mm) | 32.0 | RPM under load | 10,000 |
| r1 (mm) | 7.0 | r2 (mm) | 7.0 | B (mm) | 44.8 | Drag force (N) | 0.0 |
| θ1 (°) | 0.0 | θ2 (°) | 0.0 | C = B − A (mm) | 12.8 | angle (°) | 90.0 |
| Z1 (mm) | 19.4 | Z2 (mm) | 43.0 | | | Placement (mm) | 0.0 |

Balancing Table

| Plane | m (g) | r (mm) | mr (g*mm) | ω^2 (rad/a/s) | Force (N) mrω^2 | Force (N) Drag | Z (mm) | θ |
|---|---|---|---|---|---|---|---|---|
| **From Input** | | | | | | | | |
| 1 | 202 | 7 | 1,414.0 | 1,096,623 | 1,550.6 | | 19.4 | 0.0 |
| 2 | 75.6 | 7 | 529.2 | 1,096,623 | 580.3 | | 43.0 | 0.0 |
| Drag | | | | | | 0.0 | 0.0 | 90.0 |
| Summation (Σ) | | | | | | | | |
| **Calculated Values** | | | | | | | | |
| Balancer A | | | ★2,990.51 | 1,096,623 | 3,279.5 | | 32.0 | *−164.4 |
| Balancer B | | | ★★1,099.2 | 1,096,623 | 1,205.4 | | 44.8 | **31.6 |
| SUM | | | | | | | | |

| Plane | Balancing Plane A b | force*b | (force*b)cosθ | (force*b)sinθ | Balancing Plane B a | force*a | (force*a)cosθ | (force*a)sinθ |
|---|---|---|---|---|---|---|---|---|
| **From Input** | | | | | | | | |
| 1 | 25.40 | 39,385.9 | 39,385.9 | 0.0 | −12.60 | −19,537.9 | −19,537.9 | 0.0 |
| 2 | 1.80 | 1,044.6 | 1,044.6 | 0.0 | 11.00 | 6,383.7 | 6,383.7 | 0.0 |
| Drag | 44.80 | 0.0 | 0.0 | 0.0 | −32.00 | 0.0 | 0.0 | 0.0 |
| Summation (Σ) | | | 40,430.5 | 0.0 | | | −13,154.2 | 0.0 |
| **Calculated Values** | | | | | | | | |
| Balancer A | 12.80 | 41,977.1 | −40,430.5 | −11,289.6 | 0.00 | 0.0 | 0.0 | 0.0 |
| Balancer B | 0.00 | 0.0 | 0.0 | 0.0 | 12.80 | 15,428.2 | 13,154.2 | 8,064.0 |
| SUM | | | 0.00 | −11,289.6 | | | 0.00 | 8064.00 |

Solution Summary

-continued

TABULATION III
Free Speed, No Drag Applied Yet

| Plane | mr (g*mm) | θ (°) |
|---|---|---|
| Balancer A | 2,990.5 | −164.4 |
| Balancer B | 1,099.2 | 31.5 |

where: (from solution when drag is applied)
★(mr)A = 2,990.51 (g*mm)
*tan( θ)A = −164.4*
★★(mr)B = 1,099.2 (g*mm)
**tan( θ)B = 31.5*

Figure 2:
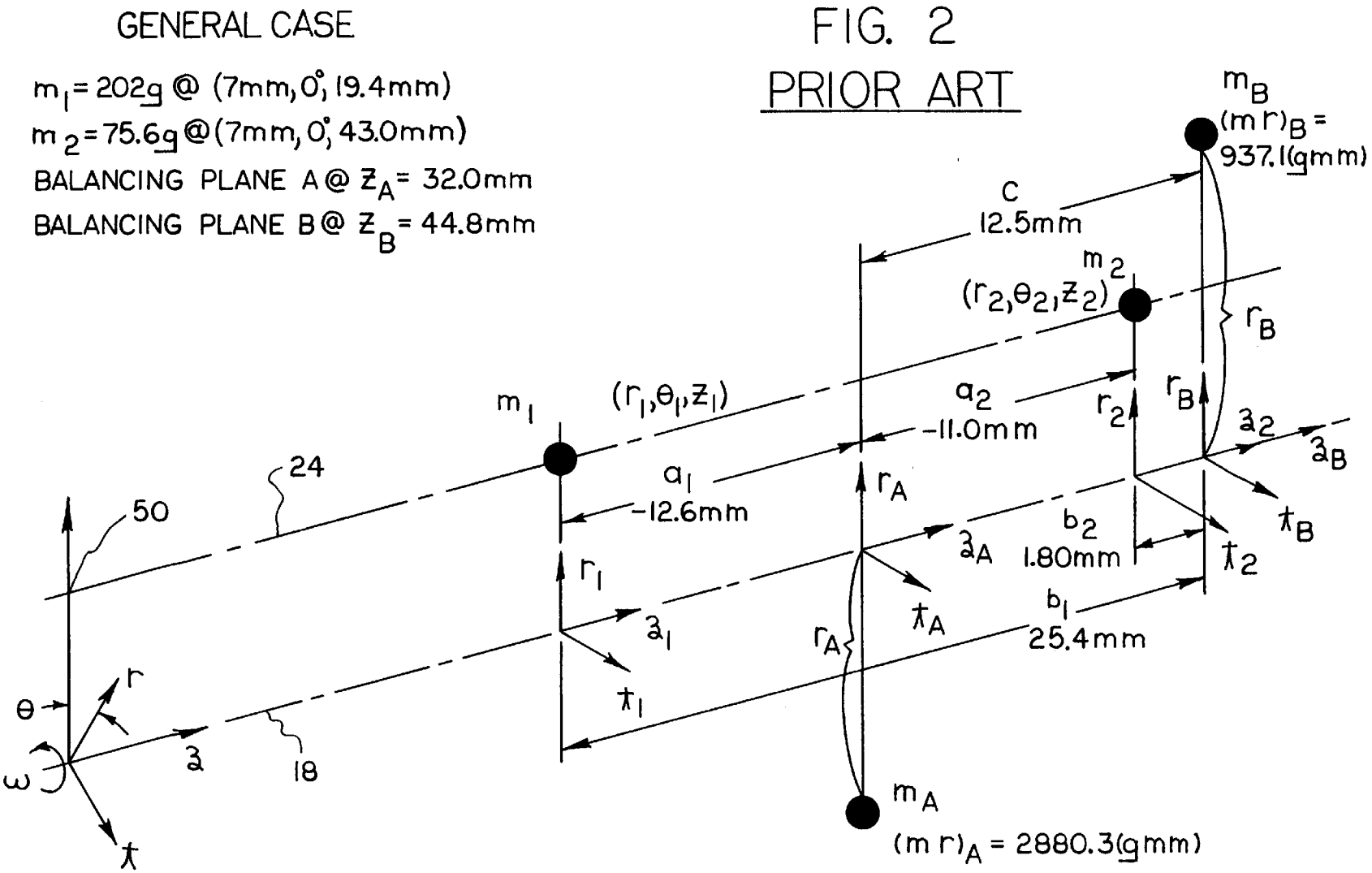
FIG. 2 PRIOR ART
FIG. 2 is a balance sketch illustrating a known mode of counterbalancing an orbital abrading machine having two mass centers arranged in an offset relationship relative to an axis of rotation or first axis.
Figure 3:
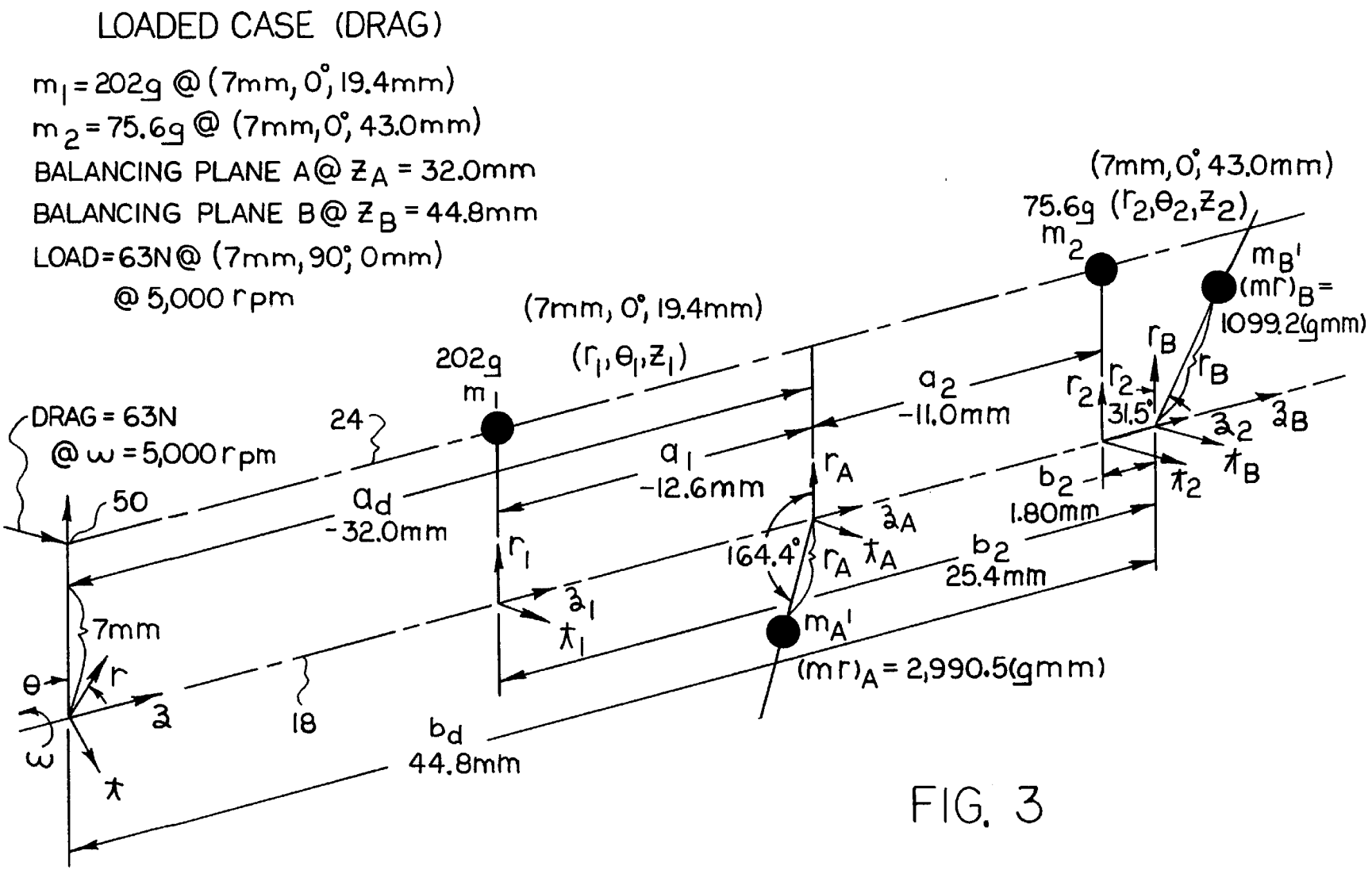
FIG. 3 is a balance sketch illustrating the present mode of counterbalancing an orbital abrading machine having mass centers arranged in the same manner as that shown in FIG. 2.

It will be understood that in order to facilitate comparison, masses $m_1$ and $m_2$ are shown in FIG. 3 and set forth in TABULATIONS II and III as being identical to those of FIG. 2 and TABULATION I, and that the location of the balancing masses $m_A^1$ and $m_B^1$ are disposed in the same planes in which balancing masses $m_A$ and $m_B$ are disposed.

The balance sketch of FIG. 3 and TABULATION II differ from FIG. 2 and TABULATION I in that they take into consideration torque applied to pad 22 in opposition to the driven rotation of assembly 20 and pad 22 about axis 18 under a predetermined working condition and the angular velocity of masses $m_1$, $m_2$, $m_A^1$ and $m_B^1$, which was determined to be 5000 rpm for the sample machine under such predetermined working conditions. As a result, the sizes and angular orientations of masses $m_A^1$ and $m_B^1$ relative to axial plane 60 required to balance the sample machine under a predetermined working condition differs from the size and orientation of masses $m_A$ and $m_B$ previously determined to be required to balance such machine while in an unloaded condition. The drag force causing the torque under the predetermined working condition of the sample machine was determined to be 63 Newtons. The drag force lies within the previously-mentioned reference plane, that is, the surface of pad 22 disposed in abrading engagement with the work surface, and passes through the center of pad 22 tangent to the orbital path of such center about axis 18.

TABULATION III differs from TABULATION II in that drag is omitted in order to illustrate how the sample machine, once balanced by masses $m_A^1$ and $m_B^1$ sized and arranged, as shown in FIG. 3, becomes unbalanced when subject to an unloaded rotational velocity determined to be 10,000 rpm.

The drag force acting on pad 22 under a predetermined working condition may be determined by first operating the orbital machine under load, in order to establish the amount of force required to be applied by an operator normal to the pad in order that a desired work surface finishing result is best achieved, and then measuring the rotational speed of pad 22 under such working condition. Thereafter such predetermined working condition may be repeated, for instance, by employing a pad subject to noticeable deflection under a given amount of operator applied force, and by using a feedback of the vibration level characteristic of a balanced machine under the predetermined working condition to train an operator to apply a relatively constant normal force to the pad.

The measured rotational speed is then used to read the torque corresponding to such speed from a torque vs. speed curve for the sample machine. The torque read from the torque vs. speed curve is then divided by the radial distance between axes 18 and 24 to obtain a value for drag force. Having both the value of the drag force and the previously measured angular velocity, the size and locations of balancing masses $m_A^1$ and $m_B^1$ may be calculated. It will be noted that the resultant positions of balancing masses $m_A^1$ and $m_B^1$ are not symmetrical relative to plane 60, as best shown in FIG. 5*a*.

As indicated above, the working condition at which a desired surface finish is obtained will determine the manner in which the sample machine is balanced, and once balanced, it will become unbalanced when run in an unloaded condition or when, for instance, it is used to perform a different type of abrading operation characterized for example as involving a different coefficient of friction between the pad and the work surface being abraded.

It is anticipated that an orbital machine may be designed for a drag force, which is less than that which would be anticipated during a predetermined working condition, in order to reduce the vibrational level occurring in the unloaded condition of the machine, while still substantially reducing the vibration level of the machine in loaded condition below that, which would have occurred incident to balancing thereof at unloaded condition without regard to drag. Moreover, it is anticipated that an orbital machine, such as an orbital sander capable of mounting sand paper in a range of grit sizes, may be balanced for a midpoint of a range of anticipated operating conditions in order to provide for an overall reduction in vibration throughout the range of anticipated use of such sander compared to that normally encountered by balancing same only in its unloaded condition.

What is claimed is:

1. In a random orbital abrading machine having a drive means rotatable about a first axis of rotation, a head portion adapted for connection with said drive means for rotation therewith about said first axis and defining a mounting recess, bearing means supported within said mounting recess and defining a second axis disposed parallel to said first axis and lying within a common plane therewith, an abrasive pad, means for connecting said pad to said bearing means for rotation about said second axis, the improvement of counterbalance means for at least substantially counterbalancing said pad and portions of said assembly not disposed concentrically of said first axis and for at least substantially counterbalancing forces to which said pad is exposed during use as a result of its engaging with a work surface characterized in that said counterbalance means includes first and second masses carried by said head portion to project in generally opposite directions radially of said first axis, said first and second masses being arranged such that they are not bisected by said plane, and said first and second masses are spaced apart lengthwise of said first axis.

* * * * *

UNITED STATES PATENT AND TRADEMARK OFFICE

CERTIFICATE OF CORRECTION

PATENT NO. : 6,206,771 B1
APPLICATION NO. : 09/236947
DATED : March 27, 2001
INVENTOR(S) : Frank D. Lehman It is certified that error appears in the above-identified patent and that said Letters Patent is hereby corrected as shown below:

In Column 3, line 63 - replace the word “sear” with the word --seal.--

Signed and Sealed this

Tenth Day of April, 2007

JON W. DUDAS
*Director of the United States Patent and Trademark Office*